US005632862A

United States Patent [19]

Ohira et al.

[11] Patent Number: 5,632,862

[45] Date of Patent: May 27, 1997

[54] ROLL FOR PAPER-MAKING MACHINE

[75] Inventors: Kazuhito Ohira; Setsuo Suzuki; Mitsuo Yamamoto, all of Mihara; Shunji Kasuga; Katsuhiko Yamada, both of Hiroshima, all of Japan

[73] Assignee: Mitsubishi Jukogyo Kabushiki Kaisha, Tokyo, Japan

[21] Appl. No.: 395,817

[22] Filed: Feb. 28, 1995

[30] Foreign Application Priority Data

Mar. 1, 1994 [JP] Japan ..... 6-031038

[51] Int. Cl.[6] ..... D21F 3/10

[52] U.S. Cl. ..... 162/368; 34/115; 34/116

[58] Field of Search ..... 492/30, 16, 20; 34/115, 116, 16, 23; 162/202, 368, 369, 371, 370, 372

[56] References Cited

U.S. PATENT DOCUMENTS

| | | | |
|---|---|---|---|
| 4,247,990 | 2/1981 | Ohs | 34/115 |
| 4,364,185 | 12/1982 | Dussourd et al. | 34/115 |
| 4,693,784 | 9/1987 | Aula et al. | 34/115 |
| 4,905,379 | 3/1990 | Wedel | 34/115 |
| 4,980,979 | 1/1991 | Wedel | 34/115 |
| 5,015,336 | 5/1991 | Roerig et al. | 162/369 |
| 5,024,729 | 6/1991 | Kuhasalo et al. | 162/372 |
| 5,347,720 | 9/1994 | Pinter et al. | 34/115 |

*Primary Examiner*—Brenda A. Lamb

*Attorney, Agent, or Firm*—Wenderoth, Lind & Ponack

[57] ABSTRACT

In a roll for a paper-making machine, a torque which is needed for rotating the roll is reduced and the drive power and a running cost are reduced. A hollow perforated roll in the paper-making machine is rotatably mounted on a bearing housing via a bearing. A cylindrical stationary center shaft extends in an axial direction through a center of the roll and has a perforated circumferential surface. At least two fins extending in an axial direction are mounted on an outer circumferential surface of the center shaft within the hollow interior of the roll, their outer edges being spaced from the inner circumferential surface of the perforated roll. Radially extending disc-like fins are also mounted on the outer circumferential surface of the center shaft perpendicular to an axis of the center shaft with their outer circumferential edges being spaced with a slight gap from the inner circumferential surface of the perforated roll. At least two of the axially extending fins are circumferentially located in the vicinity of contact points with web members wound around the perforated roll.

18 Claims, 4 Drawing Sheets

ROLL FOR PAPER-MAKING MACHINE

BACKGROUND OF THE INVENTION

The present invention relates to a roll for a paper-making machine.

A number of rolls are used for making continuous paper at a high speed. In particular, 100 or more rolls, including several tens of dryer rolls, perforated suction rolls, blow-out rolls and the like, are used generally in a dryer part where the paper is to be dried.

FIGS. 7 and 8 show conventional examples of a roll arrangement of a dryer part in a paper-making machine. First of all, FIG. 7 shows an example of a single canvas dryer in which paper 17 and canvas 16 are always travelled together. The paper 17 is travels inside the canvas 16 on dryer rolls 13 so that the paper is pressed against the surfaces of the dryer rolls 13 by the canvas 16.

However, the paper 17 is travels outside of the canvas 16 on suction rolls 14. At this time, since the vacuum of the suction rolls 14 is applied to the paper 17 through the air-permeable canvas 16, the paper 14 travels under the condition in which the paper 14 is suctioned onto the canvas.

FIG. 8 shows an example of a double canvas dryer which is characterized in that a closed space, i.e. a so-called pocket 18, is surrounded by the dryer roll 13, the paper 17, the canvas 16 and a blow-out roll 15. Since this pocket 18 is insufficient in ventilation, hot air is blown into the pocket 18 through the air-permeable canvas 16 from the blow-out roll 15.

Incidentally, the perforated roll cells are used in both suction rolls 14 in FIG. 7 and blow-out rolls 15 in FIG. 8 in the same way.

FIGS. 3 and 4 show a conventional structure of a roll for a paper-making machine in which perforated roll cells are used. In FIGS. 3 and 4, reference character 1' denotes a roll cell coupled to roll heads 2, which in turn are rotatably supported by bearing housings 4 through bearings 3. Seal rings 9 and seal bars 10 are provided in a circumferential direction and in an axial direction, respectively, between a center shaft 5 and the roll cell 1' within the roll for effecting suction/blowing for a predetermined region. In FIG. 3, reference numeral 8 denotes a damper and numeral 11 denotes a center shaft head.

However, since the roll cell 1' is in contact with the seal rings 9 and the seal bars 10, the contact thereby causes a large friction/force against the rotation of the roll, increasing the rotational torque. Also, the conventional system suffers from a disadvantage in that vibration sounds are generated by the contact in accordance with the rotation of the roll, increasing the noises.

Furthermore, a roll structure having no center shaft has been conventionally proposed as shown in FIGS. 5 and 6. However, in this case, a sufficient suction cannot be attained due to the adverse effect of a centrifugal force caused by the rotation of the roll, or the suction/blowing for the predetermined region is non-uniform or otherwise cannot be attained. Reference numeral 12 denotes a baffle plate.

In order to overcome the conventional problems, an object of the invention is to provide a roll for a paper-making machine having a center shaft in which members which are to come into contact with the roll inner surface are dispensed with.

SUMMARY OF THE INVENTION

In order to attain this and other objects, according to the present invention there is provided a roll for a paper-making machine characterized in that a hollow perforated roll to be used in the paper-making machine is rotatably mounted on a bearing housing. A cylindrical stationary center shaft extending in an axial direction through a center of the roll has a perforated circumferential surface. At least two fins is provided; and at least two fins extends in an axial direction are mounted on an outer circumferential surface of the center shaft roll within an hollow interior of the roll their outer edges being spaced from the inner circumferential surface of the perforated roll.

Furthermore, in the roll for the paper-making machine, it is preferable that at least two of the axially extending fins are circumferentially located in the vicinity of contact points with web members wound around the perforated roll. With such an arrangement, it is possible to impart an isotropic property to rigidity of the center shaft.

Also, in the roll for the paper-making machine it is preferable that radially extending disc-like fins are mounted on the outer circumferential surface of the center shaft so as to be perpendicular to an axis of the center shaft, with their outer circumferential edges being spaced with a slight gap with the inner circumferential surface of the perforated roll. A damper is provided within an interior of the center shaft. With such an arrangement, it is possible to adjust the regions of the suction/blowing in the axial direction of the roll.

In the roll for the paper-making machine according to the present invention, it is possible to avoid contact between the roll cell and the fins, enabling operation with little noise and small drive power. Also, by adjusting the perforation pattern of the center shaft and the mounting arrangement of the fins, it is possible to attain a uniform suction/blowing in a desired region. In particular, by mounting at least two axially extending fins on the outer circumferential surface of the center shaft, it is possible to prevent the air, entrained in the roll, from rotating together with the roll, thereby suppress in adverse effects of the centrifugal force.

DESCRIPTION OF THE PREFERRED EMBODIMENTS

Figure 1:
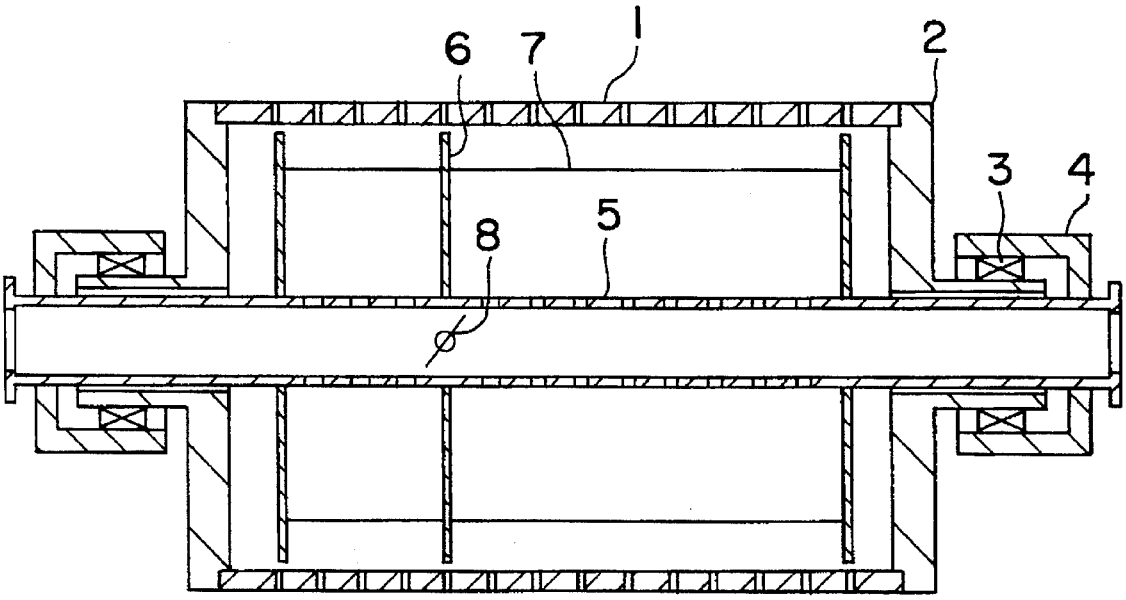
FIG. 1 is a frontal cross-sectional view showing a roll for a paper-making machine according to one embodiment of the invention.
Figure 2:
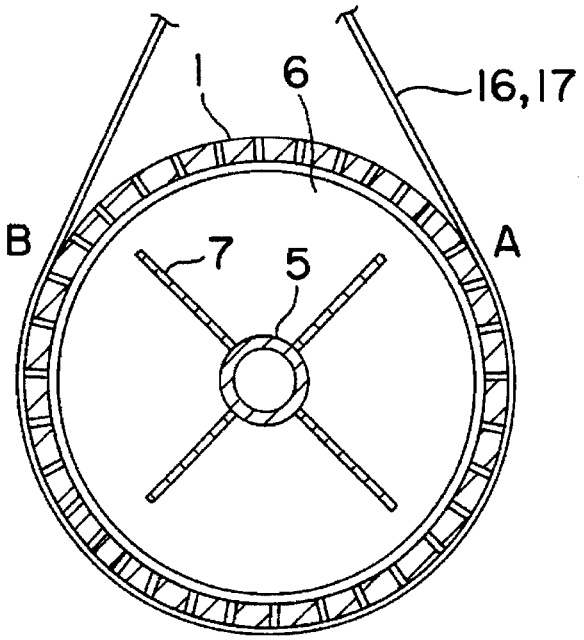
FIG. 2 is a side elevational cross-sectional view showing the roll shown in FIG. 1.
Figure 3:
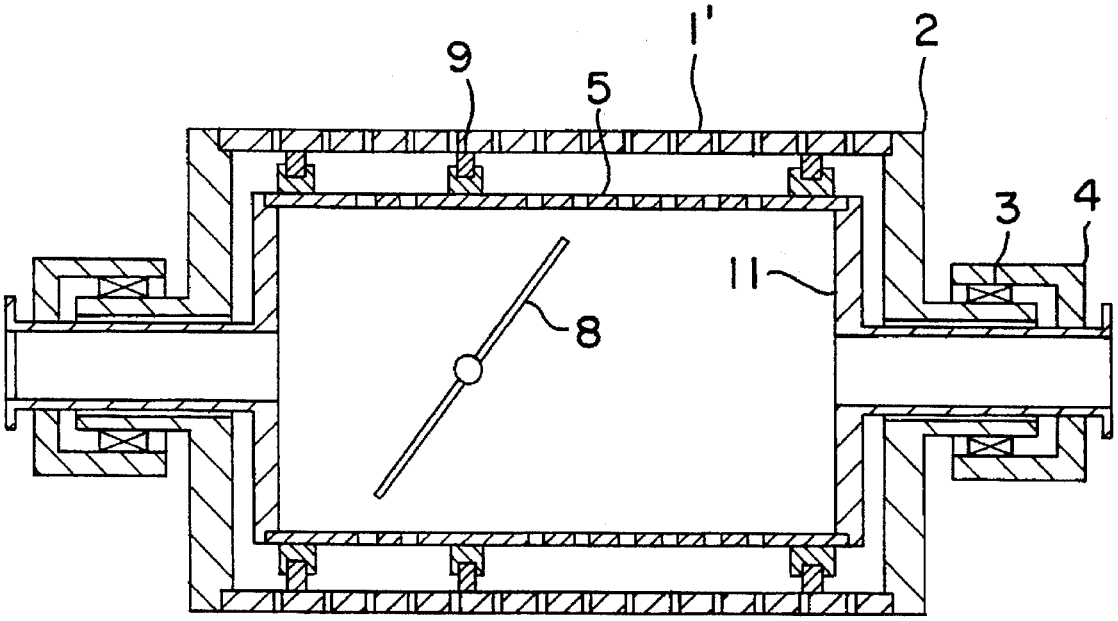
FIG. 3 (PRIOR ART)
FIG. 3 is a frontal cross-sectional view showing a conventional roll for a paper-making machine.
Figure 4:
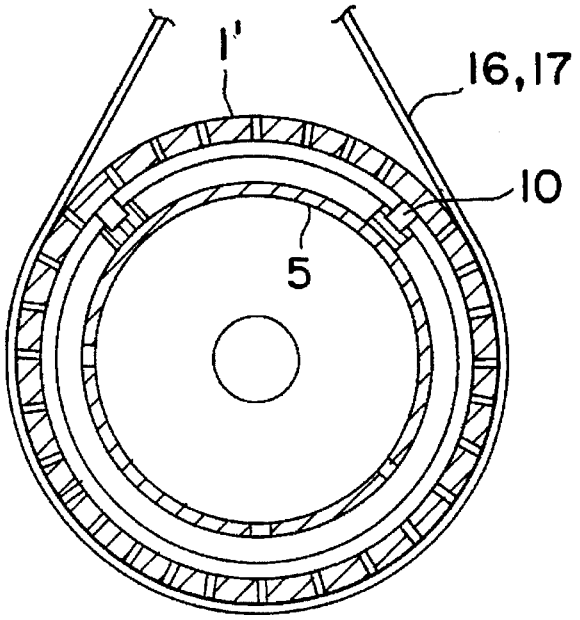
FIG. 4 (PRIOR ART)
FIG. 4 is a side elevational cross-sectional view showing the conventional roll shown in FIG. 4.
Figure 5:
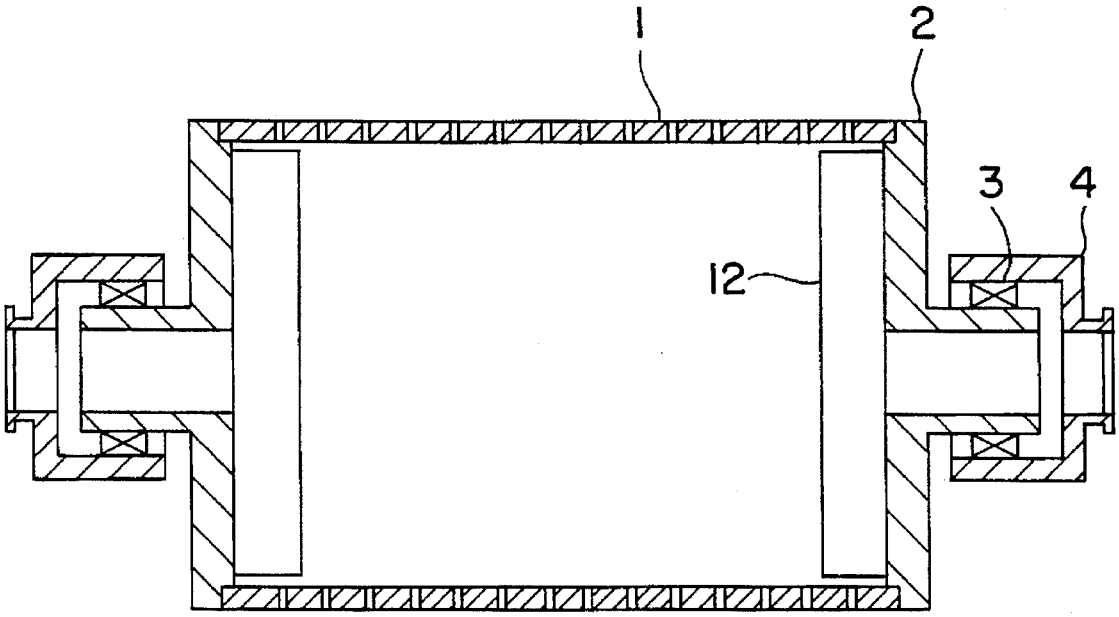
FIG. 5 (PRIOR ART)
FIG. 5 is a frontal cross-sectional view showing another conventional roll for a paper-making machine.
Figure 6:
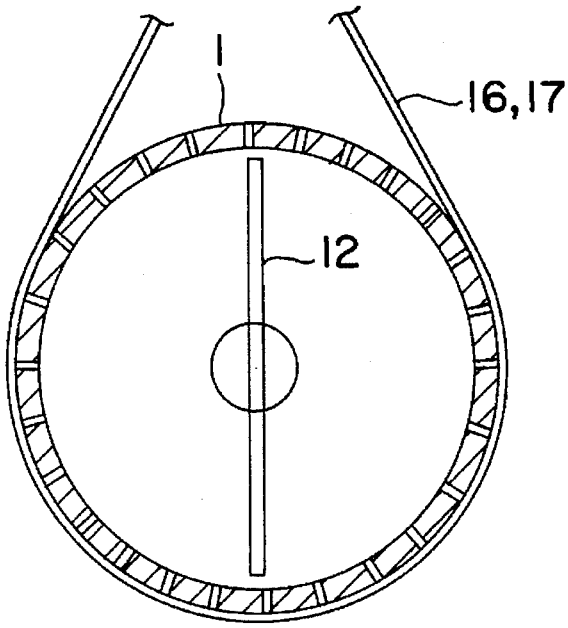
FIG. 6 (PRIOR ART)
FIG. 6 is a side elevational cross-sectional view showing the conventional roll shown in FIG. 5.
Figure 7:
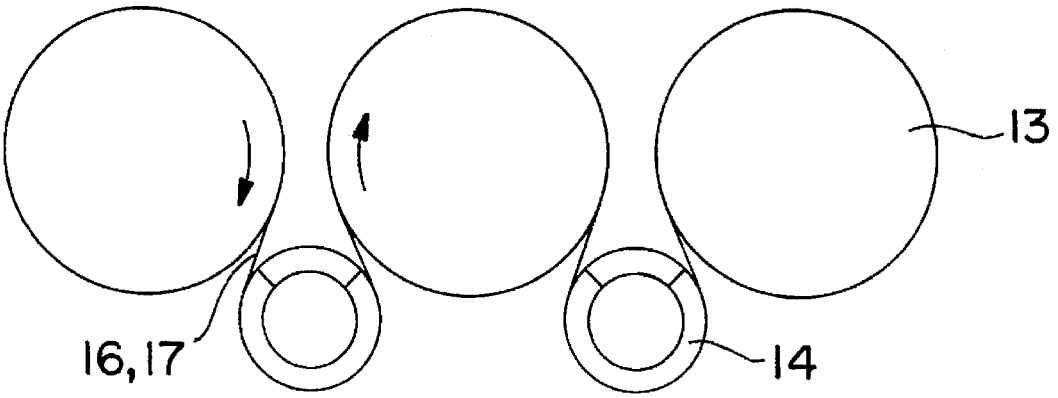
FIG. 7 (PRIOR ART)
FIG. 7 is an illustration of an arrangement of a conventional dryer rolls.
Figure 8:
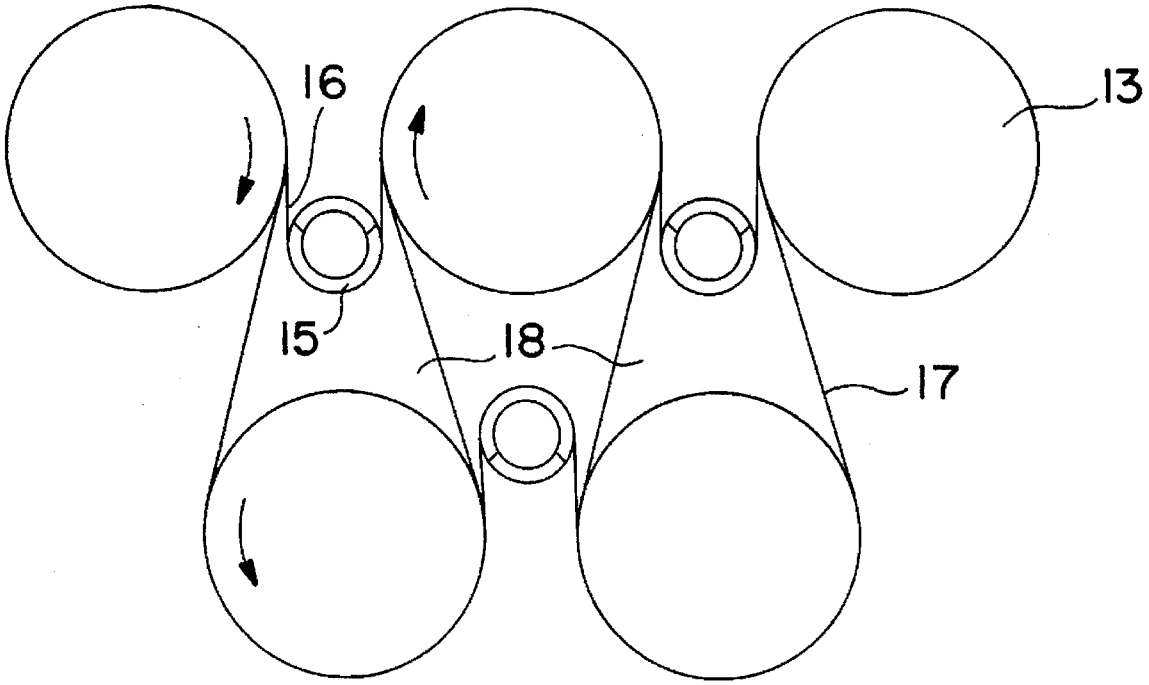
FIG. 8 (PRIOR ART)
FIG. 8 is an illustration of an arrangement of another conventional dryer rolls.

In FIGS. 1 and 2, reference numeral 1 denotes a perforated roll which is coupled with roll heads 2, which in turn are rotatably supported by bearing housings 4 through bearings 3 together with the perforated roll 1. A hollow, stationary perforated center shaft 5 is disposed within the roll 1. Four axially extending fins 7 are mounted radially outwardly of the center shaft 5 with their outer edges being spaced from an inner circumferential surface of the perforated roll 1. Also, the center shaft 5 extends outwardly from the bearing housing 4 to be connected to a hot air feeding pipe (not shown) and the like.

Furthermore, as shown in FIGS. 1 and 2, radially extending, disc-like fins 6 are mounted perpendicular to an axis of the center shaft 5 for adjusting a suction region or a blow-out region in the axial directions. The interior of the center shaft 5 is partitioned by a damper 8. A small space is provided between the inner circumferential surface of the perforated roll 1 and the outer circumferential edge of each fin 6 so as to avoid contact therebetween. At least two of the axially extending fins 7 are circumferentially located in the vicinity of contact points A and B of web members (i.e. canvas 16 and paper 17) wound around the perforated roll 1.

The space between the outer circumferential edge of each radially extending fin 6 and the inner circumferential surface of the perforated roll 1 is determined in view of the gravitational force of the roll, the tension of the web members wound around the roll, and strain caused by thermal stress and the like. In view of the seal performance, it is, however preferable not to set the space to an excessive amount.

In the foregoing embodiment, the four axially extending fins 7 are used and at least two of the fins 7 are circumferentially located in the vicinity of the contact points A and B between the perforated roll 1 and the canvas 16 or paper 17 wound around the roll 1. This arrangement is used for the purpose of isotropically imparting rigidity to the center shaft. It is sufficient to use two or more fins.

As described above in detail, according to the present invention, any members which are brought into contact with the inner circumferential surface of the perforated roll in the conventional manner are dispensed with, so that a torque for rotating the roll is decreased to thereby reduce the drive power and the running cost. Also, since the axially and radially extending fins are no longer in contact with the inner circumferential surface of the perforated roll, there is no vibration sound of the seal members. Thus, it is possible to attain a low-noise effect and to improve the working environment. Also, since there is no contact of the seal members, it is easy to perform maintenance.

Furthermore, since at least two of the axially extending fins are circumferentially located in the vicinity of the contact points with the web members wound around the perforated roll, it is possible to ensure isotropic rigidity in the center shaft.

What is claimed is:

1. A hollow perforated roll for a paper making machine rotatably mounted on a bearing housing, said hollow perforated roll comprising:

a hollow interior, an inner circumferential surface and a center;

a cylindrical stationary center shaft extending in an axial direction through said center of said hollow perforated roll, said cylindrical stationary center shaft having a perforated outer circumferential surface;

at least two fins extending in said axial direction and mounted on said outer circumferential surface of said cylindrical stationary center shaft, said at least two fins having outer edges spaced from said inner circumferential surface of said perforated roll;

wherein said center shaft has a hollow interior communicating with said outer circumferential surface thereof;

radially extending disc-shaped fins mounted on said outer circumferential surface of said center shaft perpendicular to the axis of said center shaft, said disc-shaped fins having outer circumferential edges spaced from said inner circumferential surface of said hollow perforated roll; and a damper provided within said hollow interior of said center shaft.

2. The roll of claim 1, wherein said damper is located at the same axial location in said center shaft as one of said disc-shaped fins.

3. The roll of claim 1, wherein said outer circumferential edges of said disc-shaped fins are spaced closer to said inner circumferential surface of said hollow perforated roll than said outer edges of said at least two fins.

4. The roll of claim 1, wherein said inner circumferential surface of said hollow perforated roll is free from contact with each of said disc-shaped fins and said at least two fins.

5. The roll of claim 1, wherein said disc-shaped fins each comprise annular planar members axially dividing said hollow interior.

6. The roll of claim 6, wherein said inner circumferential surface of said hollow perforated roll is free from contact and engagement with said at least two fins and said disc-shaped fins.

7. The roll of claim 1, wherein said bearing housing has said center shaft extending therethrough, said hollow perforated roll comprises roll heads supporting said hollow perforated roll therebetween, said roll heads have an inner diameter and are supported by said bearing housing, and said outer circumferential surface of said center shaft has a smaller diameter than said inner diameter of said roll heads.

8. The roll of claim 7, wherein said center shaft has a constant diameter.

9. The roll of claim 1, wherein said at least two fins each comprise a planar member.

10. A roll in a paper making machine that has adjacent rolls for transferring a web member to, winding the web member around and receiving the web member from said roll, said roll is a hollow perforated roll rotatably mounted on a bearing housing, the adjacent rolls being arranged relative to said hollow perforated roll such that contact points between the web member and said hollow perforated roll are defined on said hollow perforated roll, said hollow perforated roll comprising:

a hollow interior, an inner circumferential surface and a center;

a cylindrical stationary center shaft extending in an axial direction through said center of said hollow perforated roll, said cylindrical stationary center shaft having a perforated outer circumferential surface;

at least two fins extending in said axial direction and mounted on said outer circumferential surface of said center shaft, said at least two fins having outer edges spaced from said inner circumferential surface of said hollow perforated roll whereby said at least two fins comprise two fins adapted to be circumferentially located adjacent to the contact points when said hollows perforated roll is used in the paper making machine;

wherein said center shaft has a hollow interior communicating with said outer circumferential surface thereof;

radially extending disc-shaped fins mounted on said outer circumferential surface of said center shaft perpendicular to the axis of said center shaft, said disc-shaped fins having outer circumferential edges spaced from said inner circumferential surface of said hollow perforated roll; and a damper provided within said hollow interior of said center shaft.

11. The roll of claim 10, wherein said outer edges of said at least two fins are located closer to said inner circumferential surface of said hollow perforated roll than said outer circumferential surface of said center shaft.

12. The roll of claim 10, wherein said damper is located at the same axial location in said center shaft as one of said disc-shaped fins.

13. The roll of claim 10, wherein said outer circumferential edges of said disc-shaped fins are spaced closer to said inner circumferential surface of said hollow perforated roll than said outer edges of said at least two fins.

14. The roll of claim 10, wherein said inner circumferential surface of said hollow perforated roll is free from contact with each of said disc-shaped fins and said at least two fins.

15. The roll of claim 10, wherein said bearing housing has said center shaft extending therethrough, said hollow perforated roll comprises roll heads supporting said hollow perforated roll therebetween, said roll heads have an inner diameter and are supported by said bearing housing, and said outer circumferential surface of said center shaft has a smaller diameter than said inner diameter of said roll heads.

16. The roll of claim 15, wherein said center shaft has constant diameter.

17. The roll of claim 10, wherein said inner circumferential surface of said hollow perforated roll is free from contact and engagement with said at least two fins and said disc-shaped fins.

18. The roll of claim 10, wherein said at least two fins each comprise a planar member.

* * * * *